US011029087B2

(12) United States Patent
Kong

(10) Patent No.: US 11,029,087 B2
(45) **Date of Patent: *Jun. 8, 2021**

(54) METHOD FOR UTILIZING WASTE AIR TO IMPROVE THE CAPACITY OF AN EXISTING AIR SEPARATION UNIT

(71) Applicant: L'Air Liquide, Societe Anonyme pour l'Etude et l'Exploitation des Procedes Georges Claude, Paris (FR)

(72) Inventor: Paul Kong, Sugar Land, TX (US)

(73) Assignee: L'Air Liquide Societe Anonyme Pour L'Etude Et L'Exploitation Des Procedes Georges Claude, Paris (FR)

( * ) Notice: Subject to any disclaimer, the term of this patent is extended or adjusted under 35 U.S.C. 154(b) by 314 days.

This patent is subject to a terminal disclaimer.

(21) Appl. No.: 16/193,274

(22) Filed: Nov. 16, 2018

(65) Prior Publication Data

US 2020/0158428 A1 May 21, 2020

(51) Int. Cl.
*F25J 3/04* (2006.01)

(52) U.S. Cl.
CPC ..... *F25J 3/04393* (2013.01); *F25J 3/04109* (2013.01); *F25J 3/04618* (2013.01); *F25J 3/04793* (2013.01); *F25J 3/04951* (2013.01); *F25J 2200/04* (2013.01); *F25J 2210/40* (2013.01); *F25J 2215/40* (2013.01); *F25J 2220/40* (2013.01); *F25J 2220/68* (2013.01); *F25J 2240/10* (2013.01); *F25J 2240/90* (2013.01); *F25J 2290/40* (2013.01)

(58) Field of Classification Search
CPC .. F25J 3/04393; F25J 3/04109; F25J 3/04618; F25J 3/04793; F25J 3/04951; F25J 2200/04; F25J 2290/40; F25J 2215/40; F25J 2220/40; F25J 2220/68; F25J 2240/10; F25J 2240/90; F25J 2210/40; F25J 3/04345; F25J 3/04412; F25J 3/04969; F25J 3/04296
See application file for complete search history.

(56) References Cited

U.S. PATENT DOCUMENTS 9,574,821 B2 * 2/2017 Rauch ..... F25J 3/04303
2019/0368811 A1 * 12/2019 Zhao ..... F25J 3/04872

* cited by examiner

*Primary Examiner* — Ana M Vazquez
(74) *Attorney, Agent, or Firm* — Justin K. Murray

(57) ABSTRACT

A method for improving the capacity of an existing air separation unit employing a lost air turbine is provided in which the capacity is increased by operating the existing air separation unit as previously operated, with the exception of collecting the lost air from the lost air turbine, and instead of venting said lost air to the atmosphere, the lost air is compressed in a supplemental air compressor and returned to the air separation unit at a location downstream a front-end purification unit and upstream a booster. This setup advantageously allows for increased production without having to adjust the sizing of the front-end purification unit or main air compressor.

5 Claims, 4 Drawing Sheets

METHOD FOR UTILIZING WASTE AIR TO IMPROVE THE CAPACITY OF AN EXISTING AIR SEPARATION UNIT

TECHNICAL FIELD

The present invention generally relates to a method for revamping the capacity of an existing air separation unit. The method is particularly useful for improving capacity without having to alter the front-end precooling and purification units of the existing air separation unit.

BACKGROUND OF THE INVENTION

One type of process configuration used in an ASU producing a large quantity of liquid products is to employ a secondary air turboexpander (lost air turboexpander) in addition to a primary air turboexpander in order to increase the cold production. The secondary turboexpander usually turboexpands air from approximately 6 bar(a) to atmospheric pressure. This expanded air is usually vented as waste air after being warmed up in the main heat exchanger. The flow of this stream is typically in the range of 20 and 35% of total process air.

As shown in FIG. 1, air 2 is compressed in main air compressor (MAC) 10, then cooled in precooler 20 before being fed to front-end purification unit 30 for removal of water and carbon dioxide. The purified air stream is then compressed in boosters 40,50 and cooled in booster aftercoolers to form compressed air stream 52, which is introduced to heat exchanger 80 for cooling. First portion 54 is fully cooled and then expanded across a valve before being introduced into the double column system, which is comprised of medium pressure column 90 and low pressure column 100.

Second portion 56 is removed from an intermediate section of heat exchanger 80 and expanded across second turbine 70 before being fed into medium pressure column 90. A stream 92 having a substantially similar composition to air is withdrawn from medium pressure column 90 and warmed in heat exchanger 80, where it is withdrawn at an intermediate location and expanded across first turbine 60 to produce additional refrigeration for the system. The resulting flow 62 is eventually vented to the atmosphere.

Market condition sometimes require revamping an existing ASU to provide additional capacity compared to the original design. In some cases, the bottleneck is located in the warm end of the plant, such as air compressor, and/or air precooling, and/or air purification unit.

A traditional way to increase capacity is to install a supplemental air compressor in parallel to the existing air compressor to supply the extra process air. As shown in FIG. 2, supplemental air stream 4 is compressed in supplemental compressor 15 and combined with stream 2 upstream of front-end purification unit 30.

However, this method can only debottleneck the air compression unit. In other words, the user no longer has to purchase a larger main air compressor; however, the purification unit and precooling unit will likely need to be upgraded as well in order to handle the increased volume of air. As such, the costs of revamping the ASU will end up greatly increased.

Therefore, there exists a need for a method of improving the capacity of an existing air separation unit without having to revamp all of the components of the ASU.

BRIEF SUMMARY OF THE INVENTION

The present invention is directed to a device and a method that satisfies at least one of these needs. The objective of the current invention is to eliminate necessity of modifications on precooling and/or purification when attempting to increase the capacity of an existing air separation unit.

In one embodiment, an air recycle compressor can replace the previous supplemental air compressor from FIG. 2, such that the waste air from the lost air turboexpander can be recompressed to a pressure suitable to be re-utilized as process air. By placing the supplemental air compressor downstream of the front-end purification unit, additional air molecules can be processed without having to alter the size of the front-end purification unit, since the impurity-free (i.e., $H_2O$ and $CO_2$) recycle air will be combined into the main process air downstream of the front-end purification. Such process arrangement provides the following advantages:

- Modifications on precooling and purifications are not required.
- No additional energy is required for processing the extra process air in precooling and purification units
- Eliminate the additional pressure drop due to increase of process air in the precooling and purification units. Air compressor discharge pressure is minimized, as well as its energy consumption.
- Eliminate the additional energy required for compression of H2O and CO2 contained in the ambient air In one embodiment, a method for improving the capacity of an existing air separation unit comprising a lost air turbine is provided. In one embodiment, the existing air separation unit further comprises a main air compressor, a precooling unit, a front-end purification unit, a booster, a main heat exchanger, and a column system. In one embodiment, the method for improving the capacity can include the steps of: compressing air in the main air compressor; cooling the compressed air in the precooling unit; removing water and carbon dioxide from the compressed air in the front-end purification unit to form a dry air stream; boosting the pressure of the dry air stream in the booster to form a boosted air stream; cooling at least a first portion of the boosted air stream in the heat exchanger and expanding the first portion of the boosted air stream in a valve before sending the resulting fluid to the column system under conditions effective for separating air into nitrogen and oxygen; withdrawing a first stream from the column system and warming the first stream in the heat exchanger; withdrawing the first stream from an intermediate section of the heat exchanger and expanding the first stream in the lost air turbine to produce an expanded first stream, wherein the lost air turbine is configured to drive the booster; warming the expanded first stream in the heat exchanger; withdrawing the expanded first stream from a warm end of the heat exchanger; compressing the expanded first stream in a supplemental air compressor and cooling the compressed air to form a second compressed air; and combining the second compressed air with dry air stream downstream the front-end purification unit.

In optional embodiments of the method for increasing the capacity of an existing air separation unit:

- the booster comprises a first booster and a second booster, wherein the lost air turbine is configured to drive the first booster or the second booster, wherein the method further includes the step of cooling a second portion of the boosted air stream in a second turbine and introducing the second portion of the boosted air stream after expansion into the column system for separation therein;

the capacity of the air separation unit is increased without making adjustments to the capacity of the front-end purification; and/or the first stream has a composition substantially similar to air.

In another embodiment, the method for improving the capacity of an existing air separation unit comprising a main air compressor, a precooling unit, a front-end purification unit, a booster, a main heat exchanger, a lost air turbine, and a column system, is provided. In this embodiment, the existing air separation unit provides a portion of its refrigeration by expanding a first stream withdrawn from the column system across the lost air turbine and said first stream was previously vented to the atmosphere following warming in the heat exchanger.

In the embodiment in which the capacity of the existing ASU is improved, the method comprises the steps of: operating the existing air separation unit as previously operated, with the exception of introducing the first stream, after warming in the heat exchanger, to a supplemental air compressor to form a second compressed air; and introducing the second compressed air to a point that is located downstream the front-end purification unit and upstream the booster.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawings, in which.

DETAILED DESCRIPTION OF THE INVENTION

Figure 1:
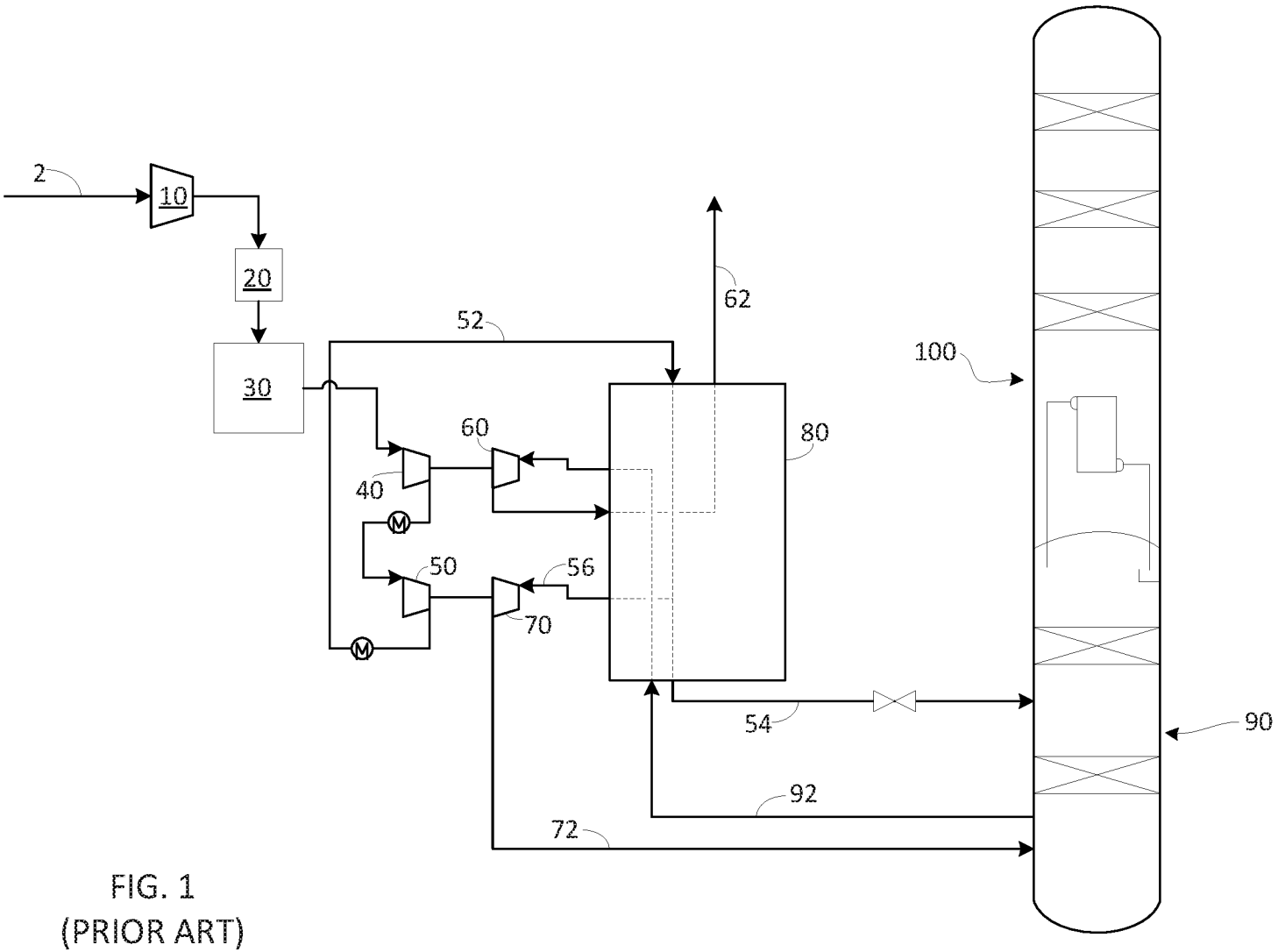
FIG. 1 (PRIOR ART)
FIG. 1 is a process flow diagram of an existing ASU.
Figure 2:
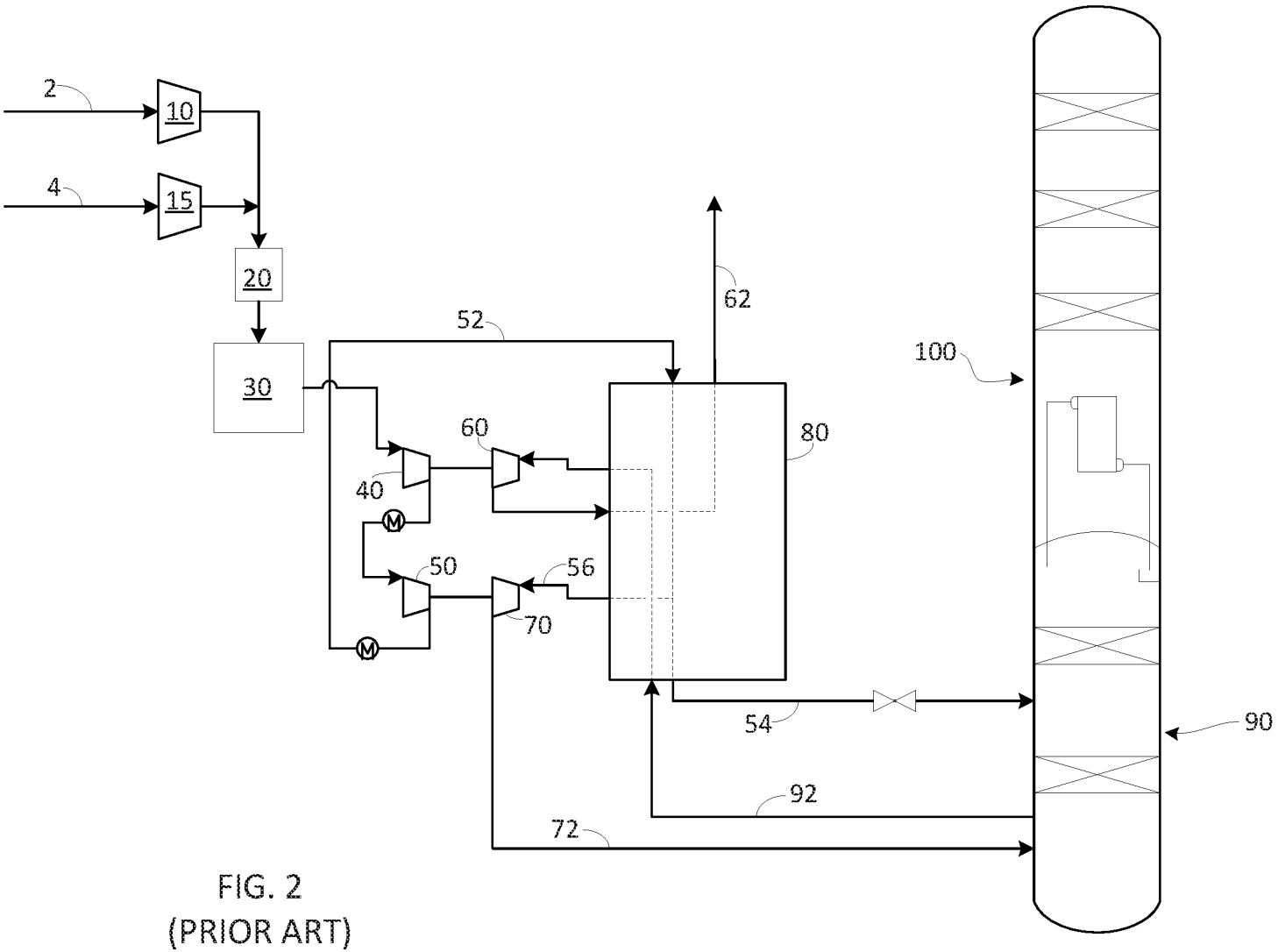
FIG. 2 (PRIOR ART)
FIG. 2 is a process flow diagram for improving the capacity of an existing ASU as known in the prior art.
Figure 3:
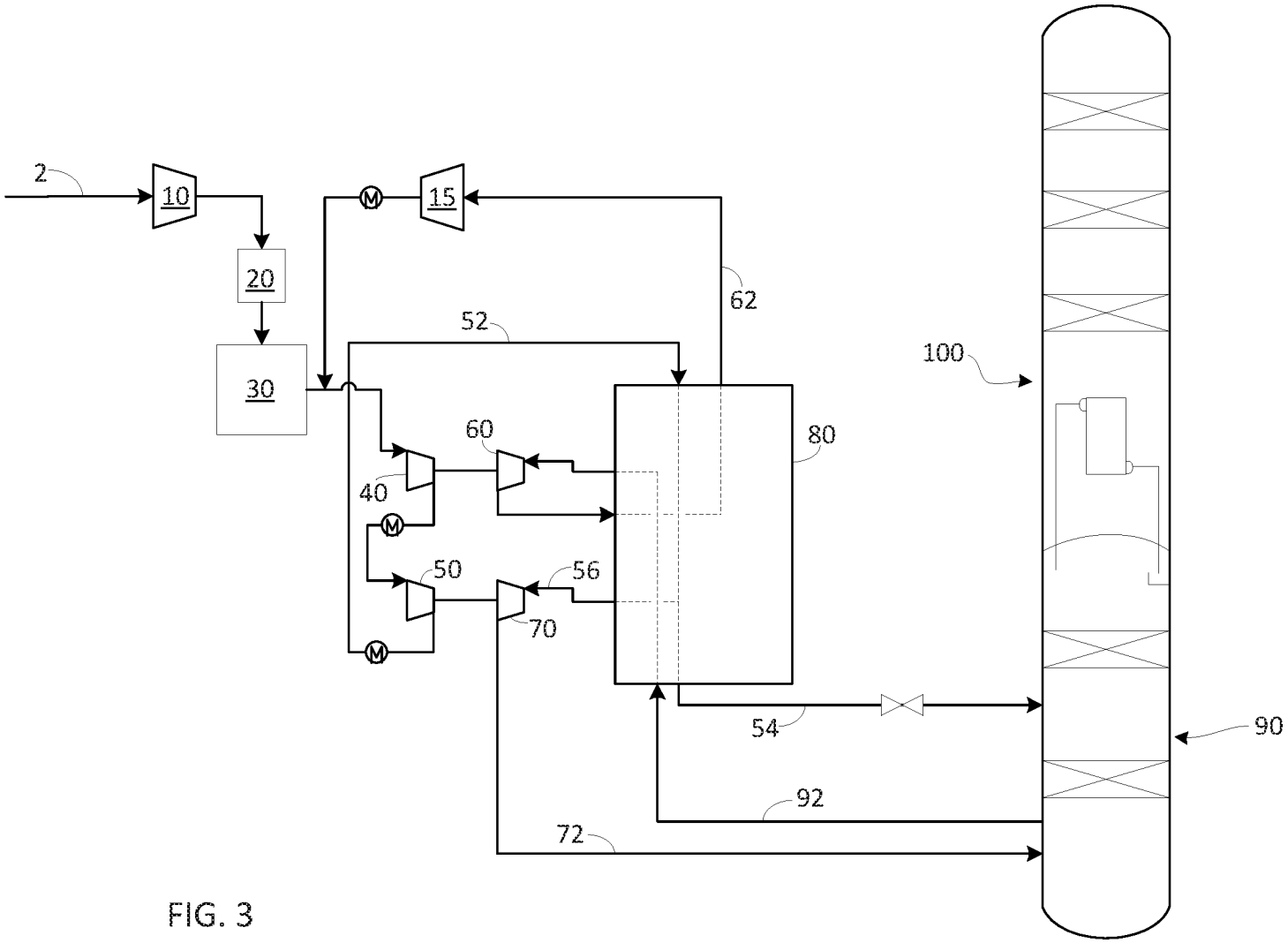
FIG. 3 is a process flow diagram for improving the capacity of an existing ASU in accordance with an embodiment of the present invention.

Referring to FIG. 3, the overall setup does not change with respect to the setup shown in FIG. 2, with the exception that supplemental air compressor 15 is configured to use waste air 62, instead of atmospheric air 4. By using waste air 62 instead of atmospheric air, the resulting compressed air stream does not need to be purified of water and carbon dioxide, which means that the compressed air stream coming from supplemental air compressor 15 can bypass front-end purification unit 30, and be introduced to the system at a location downstream front-end purification unit 30.

Figure 4:
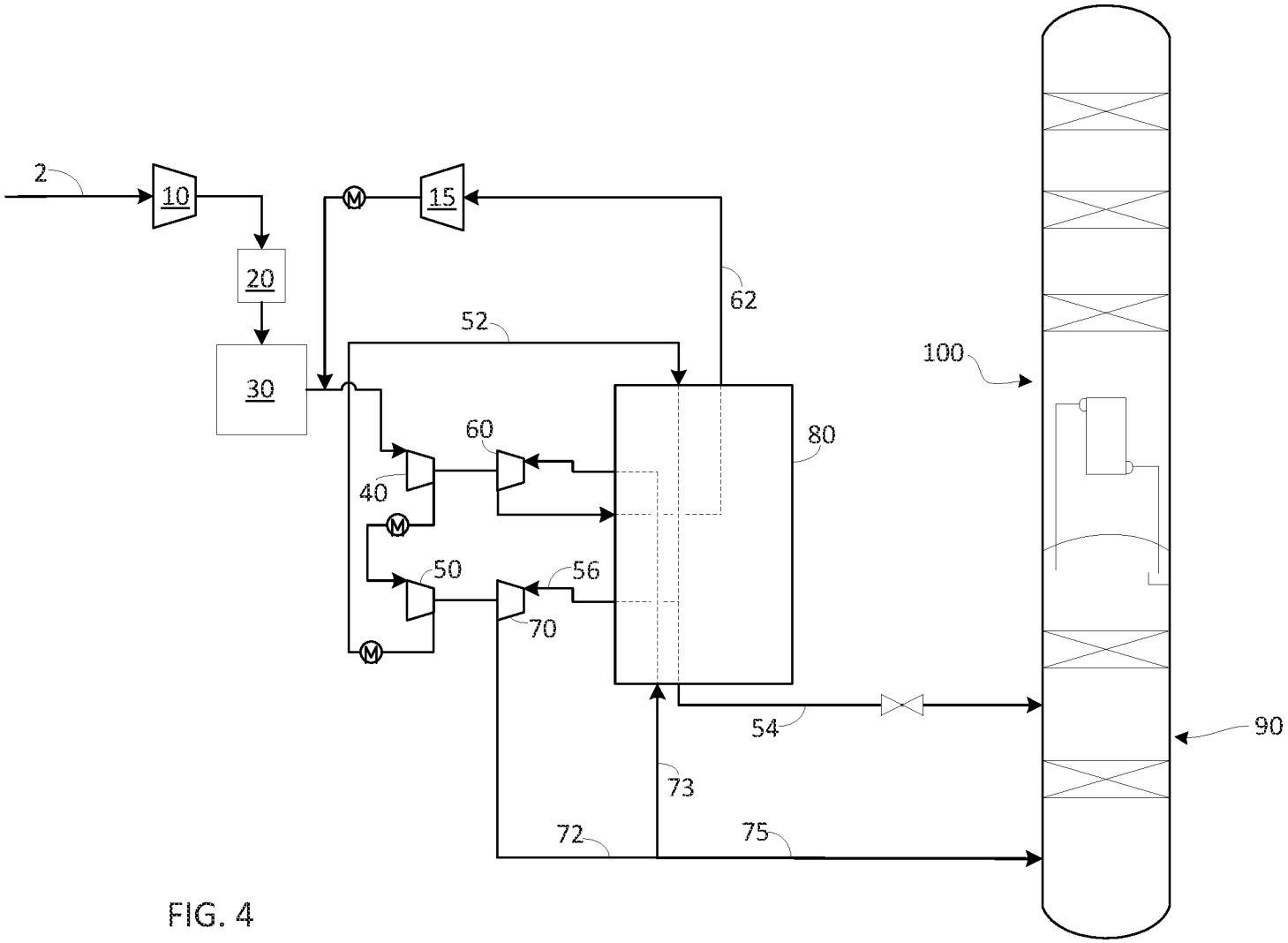
FIG. 4 is a process flow diagram for improving the capacity of an existing ASU in accordance with an embodiment of the present invention.

Referring to FIG. 4, the overall setup is similar to that of FIG. 3, with the exception that stream 72 can be split into a first fraction 73 and a second fraction 75, wherein first fraction 75 is introduced to the cold end of heat exchanger 80 while second fraction 75 is introduced to medium pressure column 90. In one embodiment, first fraction 73 accounts for between 30 and 50% of the volumetric flow of stream 72.

In another embodiment not shown, lost air turbine 60 can be configured to drive second booster 50 and turbine 70 can be configured to drive first booster 40.

Consequently, embodiments of the current invention allow for a user to increase production of an existing air separation unit without having to alter the capacity of the front-end purification unit.

As used herein, a composition substantially similar to air is one that has a nitrogen composition between 68% to 88% and an oxygen composition between 11% to 31%.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The present invention may suitably comprise, consist or consist essentially of the elements disclosed and may be practiced in the absence of an element not disclosed. Furthermore, if there is language referring to order, such as first and second, it should be understood in an exemplary sense and not in a limiting sense. For example, it can be recognized by those skilled in the art that certain steps can be combined into a single step or reversed in order.

The singular forms "a", "an" and "the" include plural referents, unless the context clearly dictates otherwise.

"Comprising" in a claim is an open transitional term which means the subsequently identified claim elements are a nonexclusive listing (i.e., anything else may be additionally included and remain within the scope of "comprising"). "Comprising" as used herein may be replaced by the more limited transitional terms "consisting essentially of" and "consisting of" unless otherwise indicated herein.

"Providing" in a claim is defined to mean furnishing, supplying, making available, or preparing something. The step may be performed by any actor in the absence of express language in the claim to the contrary a range is expressed, it is to be understood that another embodiment is from the one.

Optional or optionally means that the subsequently described event or circumstances may or may not occur. The description includes instances where the event or circumstance occurs and instances where it does not occur.

Ranges may be expressed herein as from about one particular value, and/or to about another particular value. When such particular value and/or to the other particular value, along with all combinations within said range.

All references identified herein are each hereby incorporated by reference into this application in their entireties, as well as for the specific information for which each is cited.

What is claimed is:

1. A method for improving the capacity of an existing air separation unit comprising a lost air turbine, wherein the existing air separation unit further comprises a main air compressor, a precooling unit, a front-end purification unit, a booster, a main heat exchanger, and a column system, the method comprising the steps of:

a. compressing air in the main air compressor;

b. cooling the compressed air in the precooling unit;

c. removing water and carbon dioxide from the compressed air in the front-end purification unit to form a dry air stream;

d. boosting the pressure of the dry air stream in the booster to form a boosted air stream;

e. cooling at least a first portion of the boosted air stream in the main heat exchanger and expanding the first portion of the boosted air stream in a valve before sending the resulting fluid to the column system under conditions effective for separating air into nitrogen and oxygen;

f. cooling a second portion of the boosted air stream in the main heat exchanger and expanding the second portion of the boosted air stream in an expansion turbine to produce an expanded air stream;

g. warming at least a first portion of the expanded air stream in the main heat exchanger;

h. withdrawing the at least first portion of the expanded air stream from an intermediate section of the main heat exchanger and expanding the at least the first portion of the expanded air stream in the lost air turbine to produce an expanded first stream, wherein the lost air turbine is configured to drive the booster;

i. warming the expanded first stream in the main heat exchanger;

j. withdrawing the expanded first stream from a warm end of the main heat exchanger;

k. compressing the expanded first stream in a supplemental air compressor to form a second compressed air; and l. combining the second compressed air with dry air stream downstream the front-end purification unit.

2. The method of claim 1, wherein the booster comprises a first booster and a second booster, wherein the lost air turbine is configured to drive the first booster or the second booster, wherein the method further includes the step of introducing a second portion of the expanded stream from step f) into the column system for separation therein.

3. The method of claim 1, wherein the capacity of the air separation unit is increased without making adjustments to the capacity of the front-end purification unit.

4. The method of claim 1, wherein the first stream has a composition substantially similar to air.

5. A method for improving the capacity of an existing air separation unit comprising a main air compressor, a precooling unit, a front-end purification unit, a booster, a main heat exchanger, a lost air turbine, and a column system, wherein the existing air separation unit provided a portion of its refrigeration by expanding a lost air stream across the lost air turbine and said lost air stream was vented to the atmosphere following warming in the heat exchanger, wherein the method for improving the capacity of the existing air separation unit comprises the steps of:

modifying the existing air separation unit such that the lost air stream, after warming in the main heat exchanger, is compressed in a supplemental air compressor to form a second compressed air; and introducing the second compressed air to a point that is located downstream the front-end purification unit and upstream the booster.

* * * * *